US008284006B2

(12) United States Patent
Bacarisse

(10) Patent No.: US 8,284,006 B2
(45) Date of Patent: Oct. 9, 2012

(54) PASSIVE AIR COOLING OF A DRY-TYPE ELECTRICAL TRANSFORMER

(75) Inventor: Wesley A. Bacarisse, Houston, TX (US)

(73) Assignee: Southern Transformers & Magnetics, LLC, Houston, TX (US)

( * ) Notice: Subject to any disclaimer, the term of this patent is extended or adjusted under 35 U.S.C. 154(b) by 3 days.

(21) Appl. No.: 13/042,728

(22) Filed: Mar. 8, 2011

(65) Prior Publication Data

US 2011/0254647 A1 Oct. 20, 2011

Related U.S. Application Data

(60) Provisional application No. 61/323,903, filed on Apr. 14, 2010.

(51) Int. Cl.
*H01F 27/00* (2006.01)

(52) U.S. Cl. ..... 336/90

(58) Field of Classification Search ..... 336/55–62, 336/90, 92, 210, 212
See application file for complete search history.

(56) References Cited

U.S. PATENT DOCUMENTS 717,006 A 12/1902 Johannesen
1,536,761 A 5/1925 Brand
2,339,625 A 1/1944 DeBlieux
2,424,973 A 8/1947 Edmonds
2,494,350 A 1/1950 Mittermaier
2,751,562 A * 6/1956 Camilli et al. ..... 336/60
3,160,837 A 12/1964 Jones
3,164,793 A 1/1965 Aronson
3,663,910 A * 5/1972 Grubb ..... 336/57
4,000,482 A * 12/1976 Staub et al. ..... 336/60
4,135,172 A * 1/1979 Grimes ..... 336/197
4,146,112 A 3/1979 Usry

* cited by examiner

*Primary Examiner* — Tuyen Nguyen
(74) *Attorney, Agent, or Firm* — Jeffrey L. Streets; Streets & Steele

(57) ABSTRACT

A dry-type electrical transformer system comprises a transformer and a housing. The transformer includes vertically oriented primary and secondary windings, a core extending through the primary and secondary windings, and top and bottom core clamps securing the top and bottom of the core. The housing includes a base supporting the transformer and having an air inlet, a top including an air outlet, and side walls around the transformer, wherein the housing facilitates air flow through air passages in the windings driven by natural convection in the absence of a powered air mover. Support beams allow air into a base of the housing, and the clamps are designed to allow efficient air flow into and through the air passages in the windings. A top of the housing divides the air flow into separate streams and directs the air to separate vents that release the air vertically upward.

20 Claims, 6 Drawing Sheets

10
14
16
17
18
19
20
30
32
32A
32B
32C
32D
32E
34A
34B
34C
36L
36R
38L
38R
40
42
44
46
48
50
52
54
56
58
60
62
P

PASSIVE AIR COOLING OF A DRY-TYPE ELECTRICAL TRANSFORMER

CROSS-REFERENCE TO RELATED APPLICATIONS

This application claims priority to co-pending U.S. provisional patent application Ser. No. 61/323,903, filed on Apr. 14, 2010.

BACKGROUND

1. Field of the Invention

The present invention relates to the operation of a dry-type electrical transformer, and more particularly relates to the use of air to cool a dry-type electrical transformer.

2. Background of the Related Art

A transformer is a device that transfers electrical energy from one circuit or winding to another through inductively coupled conductors. Varying current in a primary winding creates a varying magnetic flux in a ferromagnetic core of the transformer, which results in a varying magnetic field through a secondary winding. This varying magnetic field induces a varying voltage in the secondary winding. When a load is connected to the secondary winding, an electric current will flow in the secondary winding and electrical energy will be transferred from the primary circuit through the transformer to the load. In an ideal transformer, the relationship between the induced voltage in the secondary winding ($V_S$) and the voltage in the primary winding ($V_P$) and is given by the ratio of the number of turns in the secondary winding ($N_S$) to the number of turns in the primary winding ($N_P$), according to the follow equation:

$$\frac{V_S}{V_P} = \frac{N_S}{N_P}$$

Accordingly, a transformer enables an alternating current (AC) voltage to be increased by making $N_S$ greater than $N_P$, or decreased by making $N_S$ less than $N_P$.

However, the conductive metal wire used in the windings of the transformer imparts resistance to the electric current. A byproduct of this resistance is the production of heat within the metal wire. Unfortunately, the electrical resistance of the metal increases with rising temperature. Because the higher resistance will cause the production of even more heat and further reduce the efficiency of the transformer, it is important to remove heat from the transformer windings.

Some transformers are cooled by disposing them in a tank filled with oil that circulates through a radiator by natural convection or forced circulation. Other "dry type" transformers contain no liquid and are cooled by one or more gases. For example, in a ventilated dry type transformer, the transformer assembly is cooled by natural convection air currents or by forced air cooling.

BRIEF SUMMARY

One embodiment of the present invention provides a dry-type electrical transformer system, comprising a transformer and a housing. The transformer includes primary windings about a first vertical axis, secondary windings about a second vertical axis, a core extending through the primary and secondary windings, a pair of top core clamps securing the top of the core, and a pair of bottom core clamps securing the bottom of the core. Additionally, the primary and secondary windings have air passages extending from the bottom of the windings to the top of the windings. The housing includes a base supporting the transformer and having an air inlet, a top including an air outlet, and side walls extending around the transformer between the base and the top, wherein the housing provides passive convection of air flow through the air passages in the windings driven by natural convection in the absence of a powered air mover.

DETAILED DESCRIPTION

Figure 1:
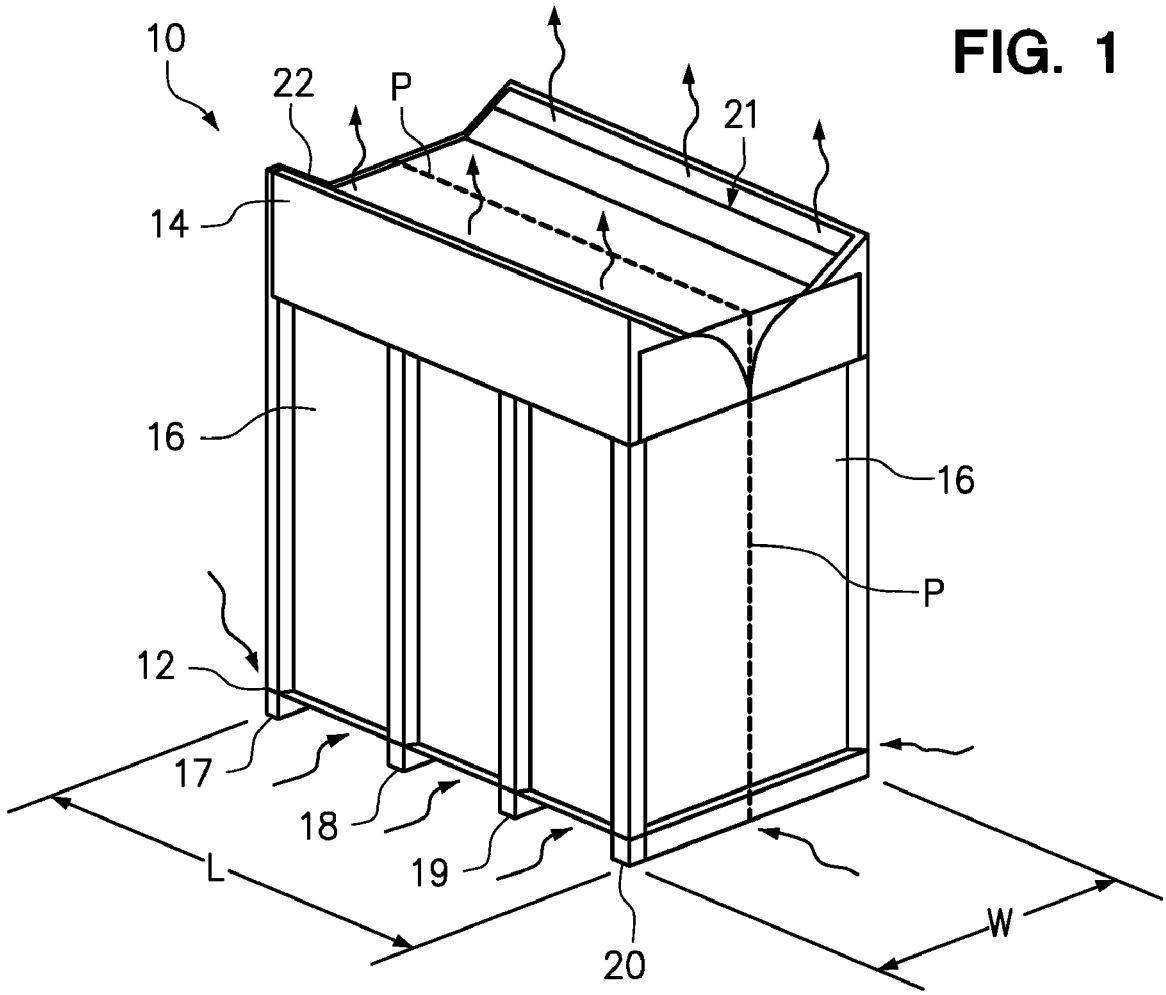
FIG. 1 is a perspective view of a transformer housing having a cool air inlet in the base and a hot air outlet in the top.

One embodiment of the present invention provides a dry-type electrical transformer system, comprising a transformer and a housing. The transformer includes primary windings about a first vertical axis, secondary windings about a second vertical axis, a core extending through the primary and secondary windings, a pair of top core clamps securing the top of the core, and a pair of bottom core clamps securing the bottom of the core. Additionally, the primary and secondary windings have air passages extending from the bottom of the windings to the top of the windings. The housing includes a base supporting the transformer and having an air inlet, a top including an air outlet, and side walls extending around the transformer between the base and the top, wherein the housing provides passive convection of air flow through the air passages in the windings driven by natural convection in the absence of a powered air mover.

The transformer will include one or more set of primary windings and one or more set of secondary windings in configurations that are well-known to those having ordinary skill in the art. Furthermore, the number of turns in each winding may vary to accomplish a desired increase or decrease in voltage. The core configuration may also vary to accommodate the winding configuration, but is preferably constructed with multiple layers of thin steel plates to reduce heating effects due to eddy currents.

The air passages through the primary and secondary windings increase the surface area of the windings that is exposed to contact with air. These air passages may form irregular patterns, but preferably form regular patterns such as concentric rings of the metal wire turns in a particular winding. Most preferably, the concentric rings of a winding are formed about a vertical leg of the core. In the embodiments shown in the figures below, the concentric rings take on the appearance of concentric cylinders with annular air passages between adjacent concentric cylinders. Air may also pass over the radially inwardly facing surface of the innermost concentric ring of wire turns, as well as the radially outwardly facing surface of the outermost concentric ring of wire turns. In one specific embodiment, each of the primary and secondary windings form concentric rings about the vertical axis, wherein the concentric rings are radially spaced apart to form vertical air passages between adjacent rings.

The metal wire used in each of the primary and secondary windings may be any of the various types known to those having ordinary skill in the art. For example, the metal wire may be a copper, aluminum, copper alloy, or aluminum alloy with or without an electrically non-conductive (electrically insulative) coating or sleeve. Optionally, the wire may be flat, such as a wire have cross-sectional dimensions of 0.1 inch× 0.5 inch, or 0.1 inch×0.4 inch. In another option, thinner copper or aluminum foil sheets can be used instead of wire, which sheets may be either bare or insulated with a varnish coating. Other wire and conductor compositions, sizes and configurations may be used, as will be know to one having ordinary skill in the art.

Narrow electrically non-conductive spacers are disposed between adjacent concentric rings of the metal wire in order to control the spacing of the rings. Multiple spacers are circumferentially spaced apart to support the spacing of the rings about the entire circumference of the windings, while leaving air passages between the spacers. In windings that have more than two concentric rings, each of the multiple spacers in a first annular space are preferably radially aligned with an equal number of spacers in an adjacent second annular space. The radial alignment of the spacers in adjacent annular spaces provides greater support between concentric rings without distorting the rings.

In a further embodiment, the top has a pair of elongate air outlet vents disposed vertically above the primary and secondary windings on opposing sides of the housing, wherein the elongate air outlet vents run parallel to the core. Optionally, the top includes first and second inwardly and upwardly directed air deflector plates extending from opposing sides of the top, and an air flow divider disposed between the pair of air deflector plates. In another option, the air flow divider has a central ridge disposed between the first and second air deflector plates, a first divider wall extending outwardly and upwardly over an inner edge of the first air deflector plate, and a second divider wall extending outwardly and upwardly over an inner edge of the second air deflector plate. In yet another option, the top has substantially no concave downward regions that would trap warm air. Preferably, the housing has no vents in the sidewalls.

In another embodiment, each of the bottom core clamps has a vertical core-engaging member with an upper edge that includes a notch in alignment with each of the primary and secondary windings. The notch facilitates air flow upward into the inner annular air passages and also to portions of the winding that are disposed within the bottom profile of the core.

In yet another embodiment, each of the bottom core clamps supports a non-conductive pad engaging a bottom edge of each primary and secondary winding, and each of the top core clamps supports a plurality of non-conductive pads that engage a top edge of each primary and secondary winding. Optionally, each of the bottom core clamps may include a plurality of separate horizontal surfaces for supporting one of the primary or secondary windings. In a further option, each of the bottom core clamps includes a plurality of gussets, wherein each gusset forms a horizontal surface for supporting one of the non-conductive pads. The pair of top core clamps preferably includes an upper horizontal flange that extends inwardly above the core and does not extend outwardly from the core.

In a particular embodiment, the housing has a raised floor defined by a plurality of horizontal support beams, wherein openings between the beams allow air to flow under the housing and upward into the housing. It is preferred, but not required, that at least a portion of the openings extend directly under the primary and secondary windings. It is also preferred, but not required, that the plurality of horizontal support beams includes at least one intermediate support beam positioned beneath a gap between adjacent windings and a pair of end support beams positioned along opposing ends of the housing. Optionally, each of the end support beams has an opening that allows air to flow under the housing.

As discussed above, the core may comprise a plurality of flat electronically conductive plates. In various embodiments of the present invention, the plurality of flat electronically conductive plates are secured together in face-to-face contact along a top edge of the plates by the top core clamps and along a bottom edge of the plates by the bottom core clamps. Typically, the top core clamps are secured together with a plurality of tie rods spaced along the length of the top core clamp and the bottom core clamps are secured together with a plurality of tie rods spaced along the length of the bottom core clamp.

FIG. 1 is a perspective view of a transformer housing 10 having a cool air inlet in the base 12 and hot air outlet vents in the top 14. It is a generally upright housing having enclosed side walls 16, a raised floor defined by support beams 17, 18, 19, 20 providing an air inlet through the base of the housing, and the top 14 having a right vent 21 and a left vent 22. Accordingly, airflow through the housing 10 is generally directed under the base 12 between the beams 17, 18, 19, 20, upward through openings in the base 12, through the housing, and out the vents 21, 22 in the top 14. The airflow is passively driven by natural convection resulting from the heat generated by a transformer inside the housing. The transformer housing 10 has been designed to efficiently utilize this natural convection to provide improved cooling of the transformer. A detailed discussion of the top 14 of the housing is provided below with respect to FIG. 4.

Although the shape of the housing may vary, the housing 10 is shown in its preferred configuration having a rectangular base 12 with a first side having a length L and a second side having a width W that is less than the length L. Accordingly, the four sides of the rectangular base 12 may be referred to collectively as sides, but the two sides having the width W may be separately referred to herein as ends. Similarly, the sidewalls 16 of the housing may be referred to collectively as sidewalls, but the two sidewalls having the width W may be separately referred to herein as end walls.

In the embodiment of FIGS. 1-4, many of the components are illustrated in a preferred configuration and may be conveniently described in relation to a vertical plane "P" that bisects the housing from end to end. It should be understood that reference to the vertical plane "P" is made to simplify the disclosure, but should not be interpreted as limiting any particular aspect of the invention. Similarly, certain components may be referred to by the designations "left" or "right" and given reference numbers ending in an "L" or "R" for convenience, but should not be interpreted as limiting the invention. Rather, components of particular embodiments are described as being "left" or "right" of the plane P as those components are shown in the figures.

Figures 2, 4, 5:
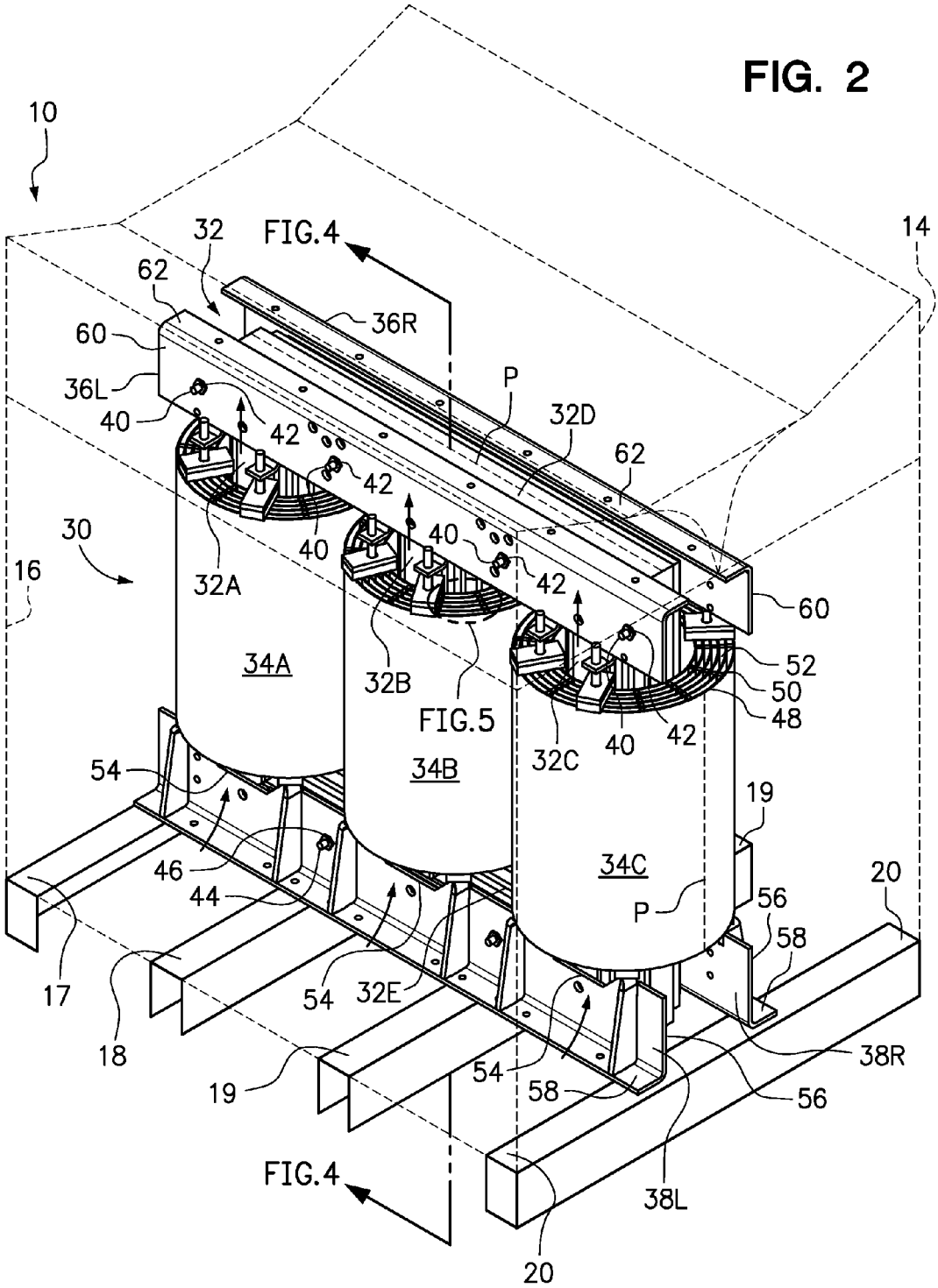
FIG. 2 is a perspective view of a transformer as it is positioned within the housing.
FIG. 4 is a cross-sectional diagram of the transformer positioned within the housing and natural convection air currents flowing through the housing from bottom to top.
FIG. 5 is a perspective view of the top edge of a transformer winding with three concentric rings partially cut-away to reveal the metal wire and spacers that form the winding.

FIG. 2 is a perspective view of a dry-type transformer 30 as it is positioned within the housing 10, which is shown in dashed lines to facilitate the view of the transformer. The transformer 30 includes a metal core 32 having three vertical legs 32A, 32B, 32C that pass through the center of each of three windings 34A, 34B, 34C, respectively, a first horizontal core segment 32D along the top of the three vertical legs, and a second horizontal core segment 32E along the bottom of the three vertical legs. The core is preferably constructed from a plurality of solid metal plates secured together in face-to-face contact, wherein each metal plate has three vertical legs and two horizontal segments. For example, each metal plate may be in the shape of a sideways "8" with squared corners and straight sides. Preferably, the width of the legs 32A, 32B, 32C and segments 32D, 32E in each plate will vary with the position of the plate within the face-to-face stack, such that the collective cross-section of the plates at each leg is roughly circular.

The plates of the core 32 are secured together using a pair of top core clamps, including left top core clamp 36L and right top core clamp 36R, and a pair of bottom core clamps, including left bottom core clamp 38L and right bottom core clamp 38R. Typically, the pair of top core clamps 36L, 36R are firmly secured about the core 32 and press the metal plates of the core together along the top segment 32D using a plurality of threaded tie rods 40 that extend through the clamps 36L, 36R and the core 32 and are tightened on each end with a mating threaded nut 42. A similar plurality of threaded tie rods 44 and mating threaded nuts 46 are used in combination with the pair of bottom core clamps 38L, 38R to press the metal plates of the core together along the bottom segment 32E. Preferably, tie rods extend through the core segments between the vertical legs and extend directly between the clamps just beyond the edge of the core. Those tie rods passing through the core preferably have a non-conductive sleeve received around the tie rod.

Each winding 34A, 34B, 34C circles around a vertical leg 32A, 32B, 32C of the core and forms multiple, generally concentric rings 48 that are separated by spacers 50 forming generally annular air passages 52 between each of the rings. When the transformer windings become warm during use, convection causes warm air to rise upward out of the top of the annular air passages 52 and cool air to be drawn upward into the bottom of the annular air passages of each of the windings.

The bottom core clamps 38L, 38R include notches 54 that allow air to flow upwardly into the bottom of the air passages near the center of the windings and the air passages that are positioned directly above the bottom core segment 32D. For the same reason, the bottom core clamps do not have a top flange. Rather, the bottom core clamps 38L, 38R are preferably "L-shaped" brackets, where each bottom core clamp has a vertical leg 56 pressing against the core and a lower horizontal leg 58 that stiffens the clamp and sits on the base support beams 17, 18, 19, 20, of the housing. The top core clamps 36L, 36R are preferably inverted "L-shaped" brackets, where each top core clamp has a vertical leg 60 against the core and a horizontal leg 62 that extends over the core where there is little airflow to be blocked.

In the embodiment shown, the core 32 extends approximately along the central plane P with individual metal plates lying in planes that are parallel to plane P. Accordingly, the top and bottom clamps are also parallel to each other and are equidistant on opposing sides of the plane P. The axial centerline of each winding lies approximately within the plane P and each axial centerline is substantially parallel to the other axial centerlines. With tolerance for some variation, this configuration is the most efficient and orients the annular air passages vertically for optimal natural convection.

Figure 3:
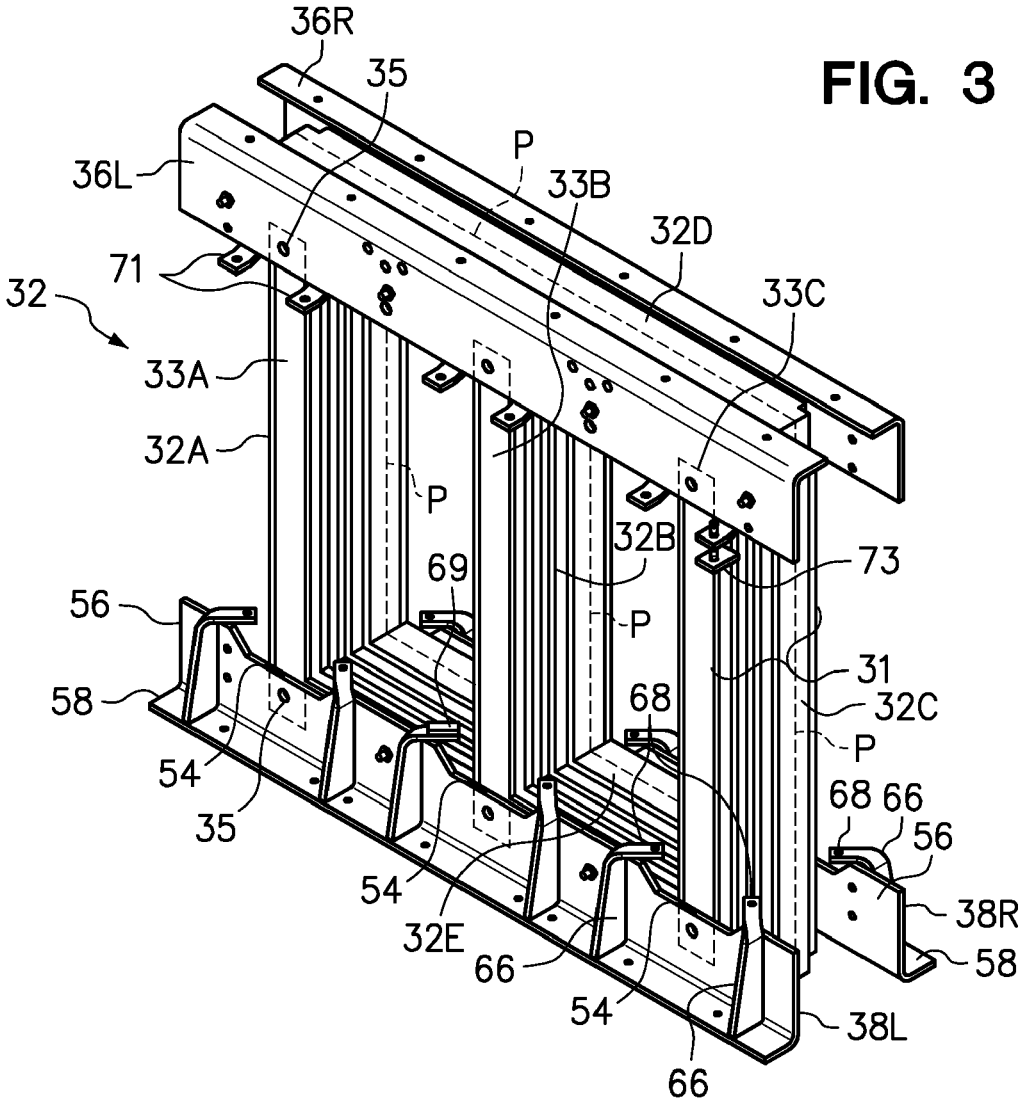
FIG. 3 is a perspective view of a transformer core secured by a pair of top core clamps and a pair of bottom core clamps.
Figure 5:
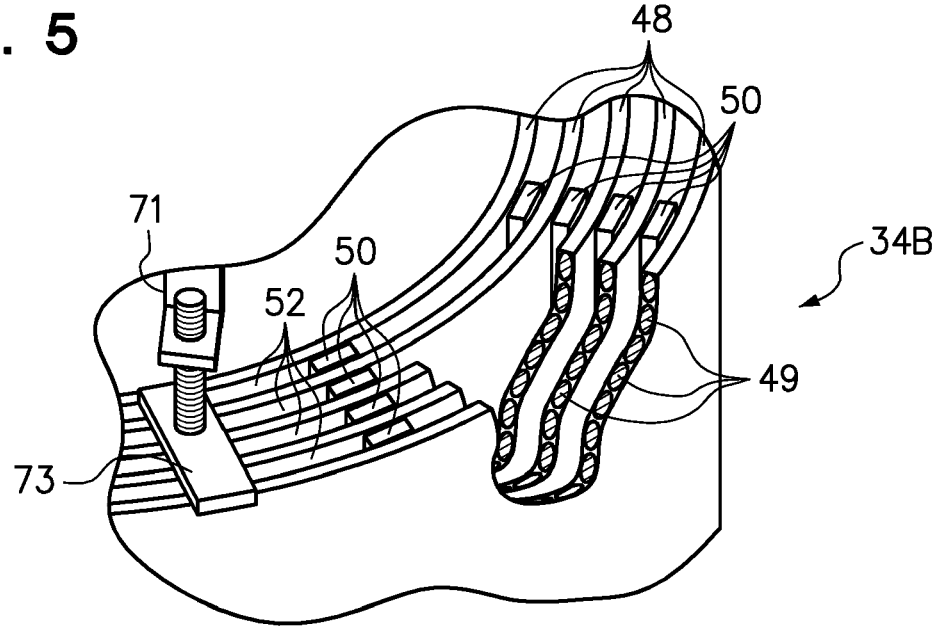
Figure 4:
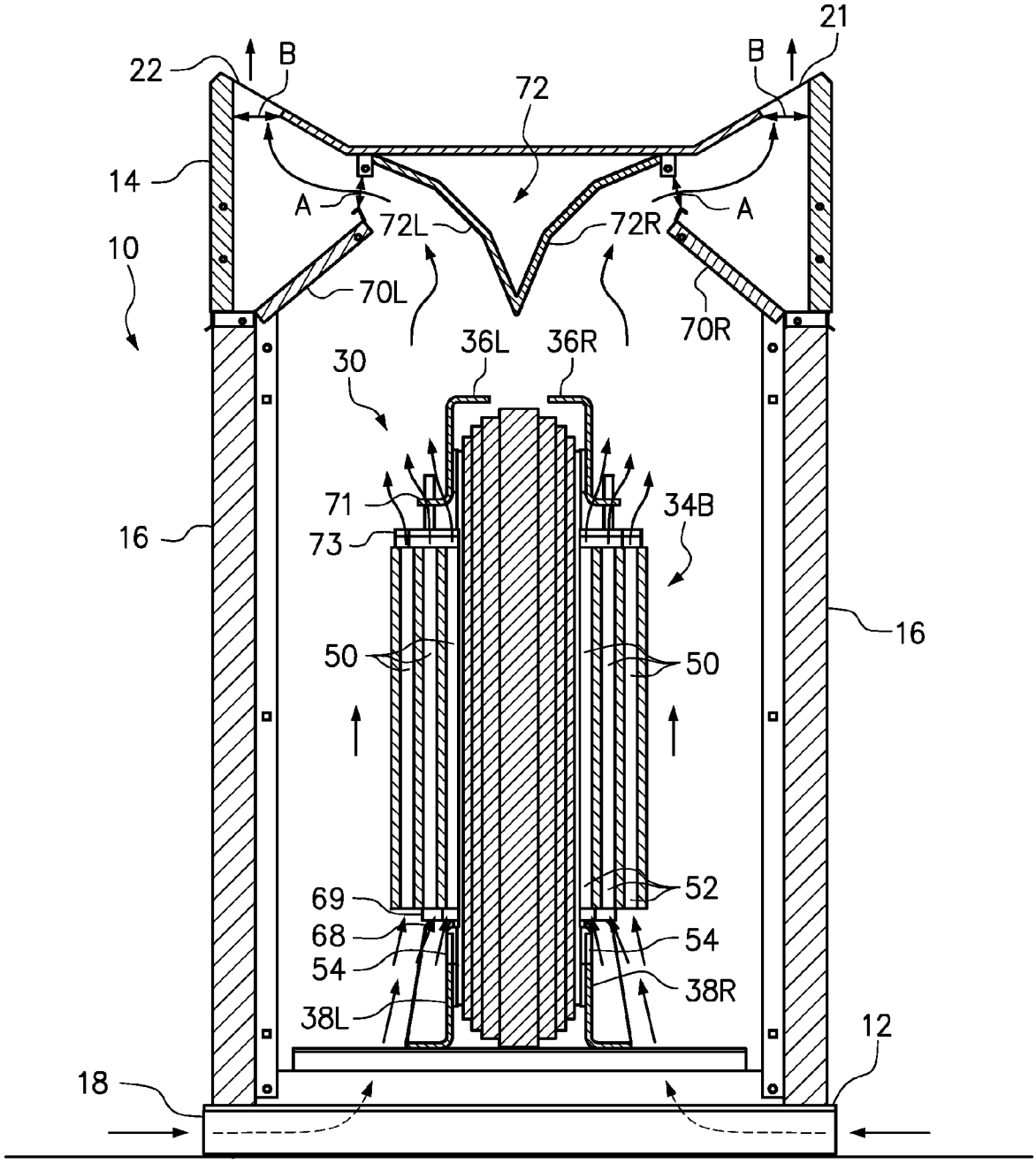

FIG. 3 is a perspective view of the transformer core 32 secured by the pair of top core clamps 36L, 36R and the pair of bottom core clamps 38L, 38R. Without the windings formed about the vertical legs 32A, 32B, 32C, the roughly circular cross-section of each vertical leg 32A, 32B, 32C and each horizontal segment 32D, 32E is shown. The roughly circular shape of these elements (i.e., the legs and the segments) is formed by stacking metal plates 31 that follow the same path (i.e., the sideways "8" with square corners and straight sides), but have varying widths on either side of that path. Accordingly, the metal plates forming the center of each core element are wider that those along the sides of each element.

Each of the bottom pair of core clamps 38L, 38R has no upper flange and the top edge of the clamp's vertical leg 56 has a notch 54 adjacent each of the core vertical legs 32A, 32B, 32C. Each notch 54 is positioned to cooperate with the roughly circular profile of the core elements to allow air to flow through the notch, upwardly and inwardly around the adjacent core elements, and into certain hard-to-reach air passages in the windings. In particular, the notch and roughly circular profile cooperate to allow air to flow into the winding's air passages that have a bottom opening directly above the horizontal segment 32E of the core. In the absence of a notch, the vertical leg 56 of each bottom core clamp 38L, 38R would effectively block air from flowing upwardly into these air passages. A preferred notch will extend downward to the same elevation as the top edge of outer-most metal plate in the horizontal segment 32E of the core.

Each of the bottom core clamps also includes a plurality of gussets 66, where each gusset 66 is secured to the leg and flange 56, 58 of the clamp 38L, 38R and has a distal end that forms a horizontal surface 68 for supporting a narrow, non-conductive pad 69 (only one shown in FIG. 3). In the embodiment shown, each bottom core clamp 38L, 38R has two winding supports 68 for each of the three windings (See also FIG. 2, windings 34A, 34B, 34C). The horizontal winding supports are preferably kept small to avoid restricting airflow into the air passages of the windings. Most preferably, the winding supports 68 and narrow, non-conductive pads 69 are aligned with a row of radially aligned, vertical spacers (See spacers 50 in FIG. 2) within the windings, so the supports 68 and pads 69 do not block significantly more air flow than would already be blocked by the vertical spacers themselves.

Similarly, the top core clamps 36L, 36R have a plurality of tabs 71, each tab supporting an adjustable pad 73 (only one shown in FIG. 3) for engaging the top edge of the windings. Most preferably, the adjustable pads 73 are aligned with a row of radially aligned, vertical spacers (See spacers 50 in FIG. 2) within the windings, so that the tabs 71 and pads 73 do not block significantly more air flow than would already be blocked by the vertical spacers themselves.

Figure 9A:
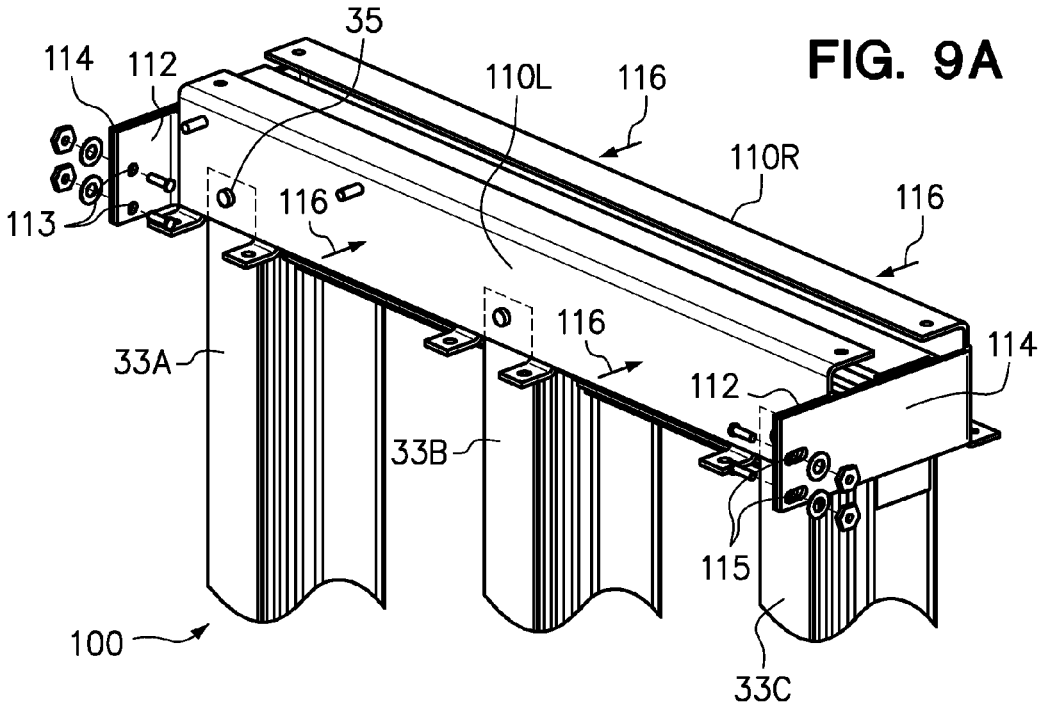
FIGS. 9A-B are perspective views of alternative top and bottom core clamps, respectively, that are particularly suitable for use with a scrapless core.
Figure 9B:
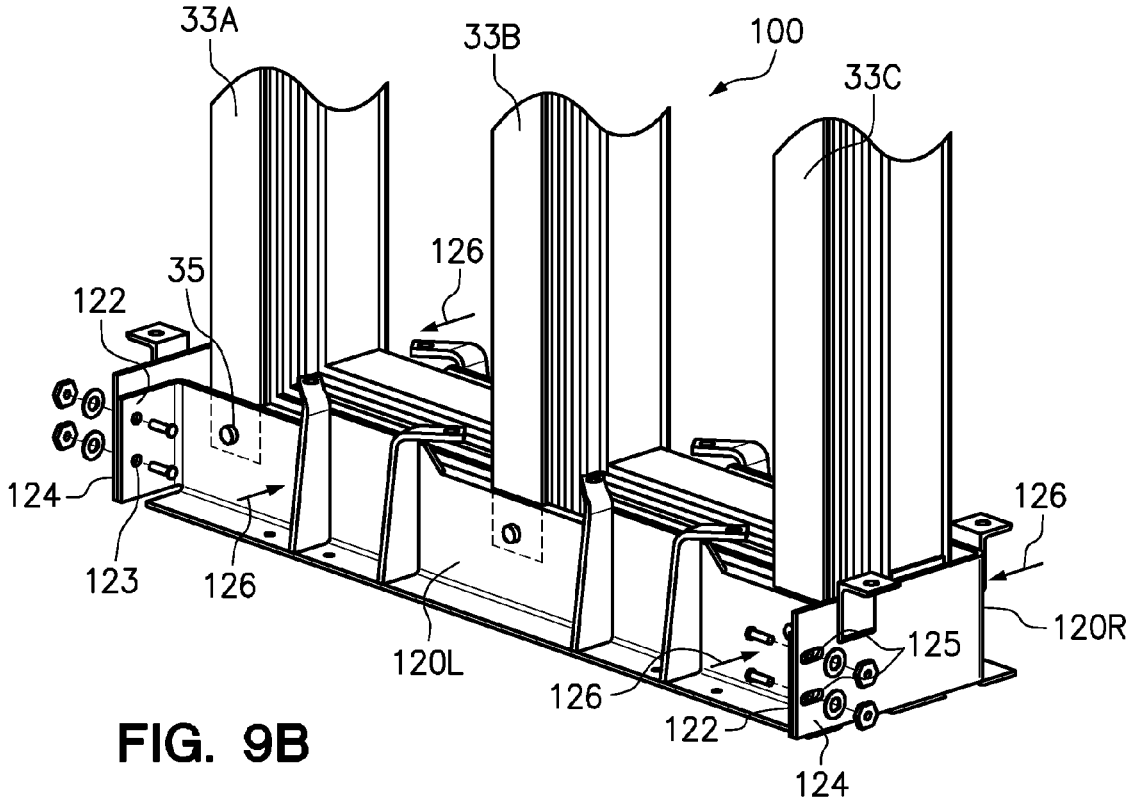

Still further, the top core clamps are preferably tied to the bottom core clamps using one or more straps that extend therebetween, such as along the outer face of each of the core vertical legs 32A, 32B, 32C. In the embodiment of FIG. 3, three straps 33A, 33B, 33C extend vertically between the top and bottom core clamps and have an upper end that is disposed between the top left core clamp 36L and the core vertical legs 32A, 32B, 32C, and a lower end that is disposed between the bottom left core clamp 38L and the core vertical legs 32A, 32B, 32C. Each strap has a first outwardly facing peg 35 that extends through a hole in the top left core clamp 36L and a second outwardly facing peg 35 that extends through a hole in the bottom left core clamp 38L. Accordingly, the vertical spacing and positioning of the top and bottom core clamps is secured. A similar set of three straps is preferably position on the back side of the core to extend between the top and bottom right core clamps 36R, 38R. While such straps are optionally used in various embodiments, the use of these straps is particularly important with a scrapless core where there are no tie rods extending through the core to prevent the clamps from shifting out of position. FIGS. 9A-9B, discussed below, show a scrapless core and alternative clamps that utilize the same straps 33A, 33B, 33C.

FIG. 4 is a cross-sectional diagram of the transformer 30 positioned within the housing 10. The cross-section is taken along line 4-4 shown in FIG. 2, and cuts a plane that is perpendicular to plane P of FIG. 2 through the middle of winding 34B. Wavy arrows are shown to illustrate the natural convection of air flowing through the housing from bottom to top as a result of heat produced by the transformer. Air flows generally horizontally between the support beams (only beam 18 is shown), upwardly through the base 12, past the bottom core clamps 38L, 38R, and into the air passages 52 of the windings 34B. The air passages 52 are delineated by the concentric rings 48 of metal wire used to construct the windings. The width of the air passages 52 is established by the vertical spacers 50 between each of the concentric rings 48. The vertical spacers 50 are narrow in width relative to the circumference the concentric rings 48 such that the annular space between rings 48 is substantially open.

Referring briefly to FIG. 5, a perspective view of the top edge of the transformer winding 34B is shown with five concentric rings 48. Each ring 48 is separated from the adjacent ring 48 by narrow spacers 50 that are radially spaced apart about the circumference of the rings. Each pair of adjacent rings 48 defines an annular space in which the spacers 50 are located. The spacers 50 divide up the annular space into a plurality of vertical air passages 52. The outer three rings 48 are shown partially cut-away to reveal the metal wire 49 that forms the windings.

Referring back to FIG. 4, the air within the passages 52, as well as air coming into contact with the outer and inner surfaces of the windings, takes on heat from the windings. This hot air rises upwardly through the air passages 52, out the top of the winding 34B, and past the top core clamps 38L, 38R. As the hot air continues to rise into the top 14, the air is directed through a pair of narrowing passages between a pair of upwardly and inwardly directed side deflectors 70L, 70R and the two sides 72L, 72R of a central air flow divider 72. The air flow divider 72 separates the airflow into separate streams and directs the separate streams toward the two separate vents 21, 22. Each vent 21, 22 runs the length L of the housing (See also FIG. 1) and releases the warm air vertically out the top of the housing. The side deflectors 70L, 70R extend inwardly under the exhaust vents 22, 21, respectively, and are each angled downwardly and outwardly so that any water entering downwardly into the exhaust vents 22, 21, would not have a direct line to the transformer core and coil, but would be directed out of the housing and down the side walls 16 of the enclosure. In a preferred embodiment, the opening between the air divider and each air deflector will have a dimension A that is approximately the same as the dimension B of the exhaust vent opening so as to avoid creating any turbulence or back pressure in the air leaving the enclosure.

It should be recognized that the hot air rising out the top of the housing is responsible for drawing in cooler air in the bottom of the housing as described. This action may be referred to as "natural convection" or the "chimney effect." However, it is the heat transfer from the windings that forces air to pass upward through the housing.

Because the air inlet is in the bottom of the housing and the air vents are in the top of the housing, the transformer housing may be beneficially positioned close to a wall or close to other similar transformer housings without obstructing the flow of air through the housing. Therefore, the transformer windings are adequately cooled so that the transformer performance can be maintained, while the amount of floor space required to support the cooling is reduced. Previously known transformers with vents in the side walls of the housing require substantial spacing between adjacent walls and transformers to support proper cooling.

Figure 6:
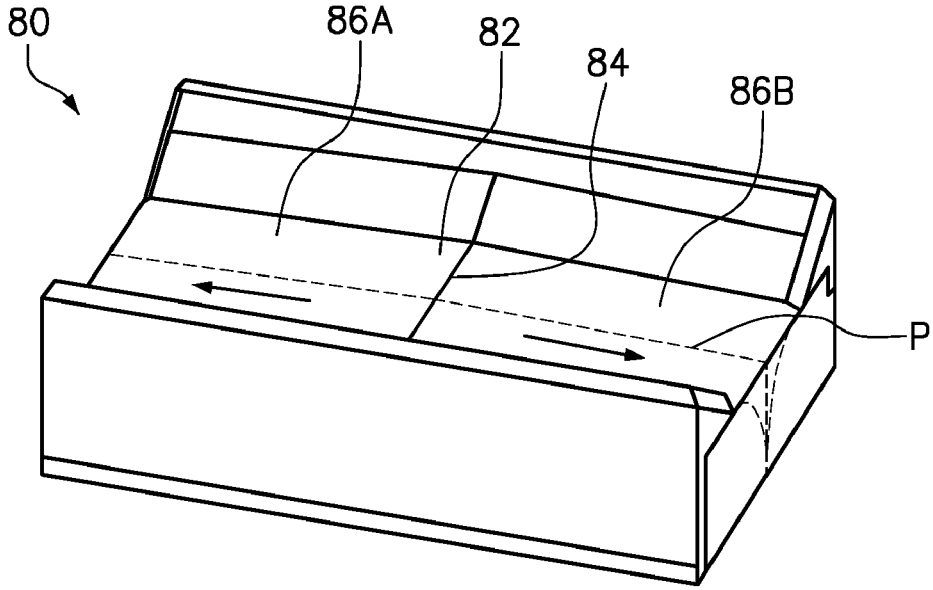
FIG. 6 is a perspective view of an alternative top to the transformer housing, wherein the top has a pitched roof to shed water.

FIG. 6 is a perspective view of an alternative top 80 that may be used on the transformer housing 10, wherein the top 80 has a pitched roof 82 to shed water. The roof 82 has a central ridge 84 that divides the roof into two surfaces 86A, 86B that are downwardly sloping along the plane P in the direction of the arrows outwardly away from the ridge 84.

Figure 7:
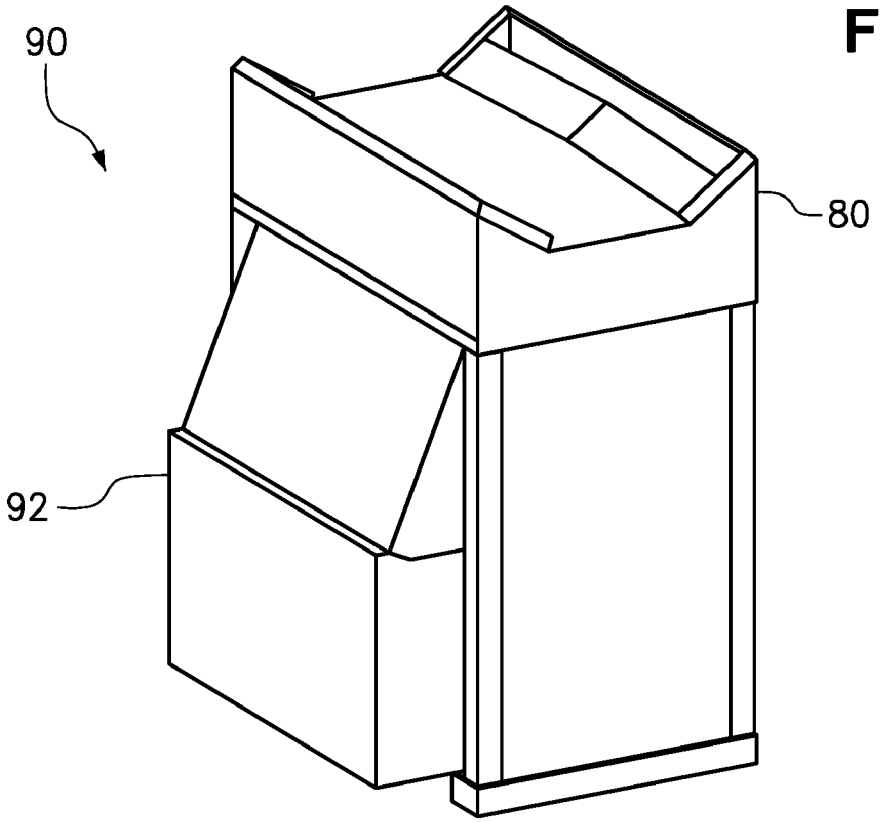
FIG. 7 is a perspective view of the housing where one of the side wall panels has been replaced with a cable access compartment.

FIG. 7 is a perspective view of a housing 90 that is substantially the same as housing 10 of FIG. 1, except that one of the side wall panels has been replaced with a cable access compartment 92. The cable access compartment 92 is useful for receiving and directing cables to and from the transformer inside the housing 90 without interfering with the air flow patterns described above. In addition, the cable access compartment enables the rest of the housing to remain small and narrow, without large excessive spaces around the transformer. A narrow housing, such as that shown in the cross-sectional side view of FIG. 4, keeps the hot air flowing upwardly in an effective manner to draw additional cool air into the housing.

Figure 8:
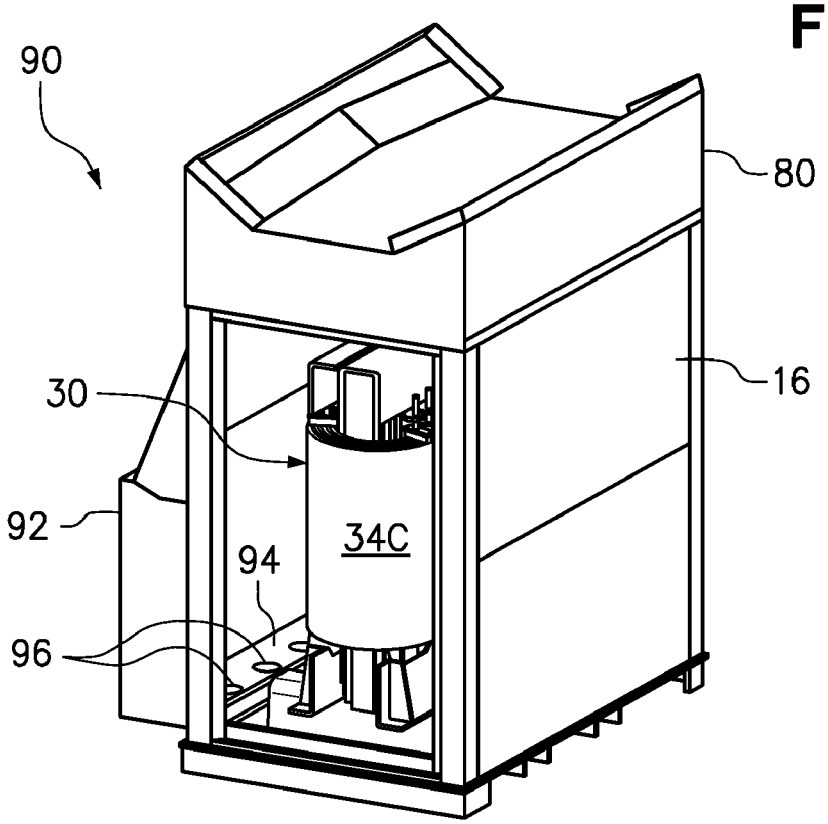
FIG. 8 is a perspective view of the housing of FIG. 7 with an end wall panel removed to show the inside of the cable access compartment.

FIG. 8 is a perspective view of the housing 90 of FIG. 7 with an end wall panel removed to show the inside of the cable access compartment 92. The compartment has a bottom wall 94 with a plurality of circular cable passages 96 positioned along the length of the transformer. The compartment preferably narrows toward the top.

FIGS. 9A-B are perspective views of alternative top and bottom core clamps, respectively, that are particularly suitable for use with a scrapless core. Referring first to FIG. 9A, the scrapless core 100 does not have holes there through for receiving a tie rod. Rather, the opposing clamp members (See top left core member 110L, top right core member 110R, bottom left core member 120L, and bottom right core member 120R) are held together at the ends using overlapping brackets. Specifically, in FIG. 9A the top left core clamp 110L has a forwardly extending bracket 112 at each end, and the top right core clamp 110R has a forwardly extending bracket 114 at each end that overlaps the bracket 112 in face-to-face contact. Each bracket 112 includes a pair of holes 113 and each bracket 114 includes a pair of slots 115 that align with the opposing holes 113 for receiving a bolt there through. When the clamps are pushed together (as shown by the arrows 116), a nut is tightly secured to the bolt so that the clamps are secured together in position.

In FIG. 9B the bottom left core clamp 120L has a forwardly extending bracket 122 at each end, and the top right core clamp 120R has a forwardly extending bracket 124 at each end that overlaps the bracket 122 in face-to-face contact. Each bracket 122 includes a pair of holes 123 and each bracket 124 includes a pair of slots 125 that align with the opposing holes 123 for receiving a bolt there through. When the clamps are pushed together (as shown by the arrows 126), a nut is tightly secured to the bolt so that the clamps are secured together in position.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A dry-type electrical transformer system, comprising:

a transformer including primary windings about a first vertical axis, secondary windings about a second vertical axis, a core extending through the primary and secondary windings, a pair of top core clamps securing the top of the core, and a pair of bottom core clamps securing the bottom of the core, wherein the primary and secondary windings have air passages extending from the bottom of the windings to the top of the windings; and a housing including a base having an air inlet, a top including an air outlet, and side walls extending around the transformer between the base and the top, wherein the transformer is disposed within the housing and supported by the base, and wherein the housing provides passive convection of air flow from the air inlet, through the air passages in the windings, and to the air outlet driven by natural convection in the absence of a powered air mover.

2. The system of claim 1, wherein the top has a pair of elongate air outlet vents disposed vertically above the primary and secondary windings on opposing sides of the housing, wherein the elongate air outlet vents run parallel to the core.

3. The system of claim 2, wherein the top includes first and second inwardly and upwardly directed air deflector plates extending from opposing sides of the top, and an air flow divider disposed between the pair of air deflector plates.

4. The system of claim 3, wherein the air flow divider has a central ridge disposed between the first and second air deflector plates, a first divider wall extending outwardly and upwardly over an inner edge of the first air deflector plate, and a second divider wall extending outwardly and upwardly over an inner edge of the second air deflector plate.

5. The system of claim 1, wherein each of the primary and secondary windings form concentric rings about the vertical axis, wherein the concentric rings are radially spaced apart to form vertical air passages between adjacent rings.

6. The system of claim 1, wherein the pair of bottom core clamps each have a vertical core-engaging member with an upper edge that includes a notch in alignment with each of the primary and secondary windings.

7. The system of claim 1, wherein the pair of bottom core clamps each support a non-conductive pad engaging a bottom edge of each primary and secondary winding, and wherein the pair of top core clamps each support a plurality of non-conductive pads that engage a top edge of each primary and secondary winding.

8. The system of claim 7, wherein the pair of bottom core clamps include a plurality of separate horizontal surfaces for supporting one of the primary or secondary windings.

9. The system of claim 7, wherein the pair of bottom core clamps each include a plurality of gussets, each gusset forming a horizontal surface for supporting one of the non-conductive pads.

10. The system of claim 1, wherein the pair of top core clamps include an upper horizontal flange that extends inwardly above the core and does not extend outwardly from the core.

11. The system of claim 1, wherein the housing has a raised floor defined by a plurality of horizontal support beams, and wherein openings between the beams allow air to flow under the housing and upward into the housing.

12. The system of claim 11, wherein at least a portion of the openings extends directly under the primary and secondary windings.

13. The system of claim 11, wherein the plurality of horizontal support beams includes at least one intermediate support beam positioned beneath a gap between adjacent windings and a pair of end support beams positioned along opposing ends of the housing.

14. The system of claim 13, wherein each of the end support beams has an opening that allows air to flow under the housing.

15. The system of claim 1, wherein the core comprises a plurality of flat electronically conductive plates, and wherein the plurality of flat electronically conductive plates are secured together in face-to-face contact along a top edge of the plates by the top core clamps and along a bottom edge of the plates by the bottom core clamps.

16. The system of claim 15, wherein the top core clamps are secured together with a plurality of tie rods, and wherein the bottom core clamps are secured together with a plurality of tie rods.

17. The system of claim 15, wherein each of the top and bottom core clamps has a bracket secured to each end of the clamp, each bracket extending to the same side of the core, wherein the brackets are selectively fastenable to secure the clamps in a clamping position about the core without extending fasteners through the core.

18. The system of claim 15, further comprising:

one or more straps extending between the top and bottom core clamps to secure the spacing between the top and bottom core clamps.

19. The system of claim 1, wherein the top has substantially no concave downward regions that would trap warm air.

20. The system of claim 1, wherein the housing has no vents in the sidewalls.

* * * * *